United States Patent [19]

Mitchard

[11] 4,044,658

[45] Aug. 30, 1977

[54] APPARATUS FOR FOLDING PANELS OF CARTON BLANK

[75] Inventor: John M. Mitchard, Cherry Hill, N.J.

[73] Assignee: Union Camp Corporation, Wayne, N.J.

[21] Appl. No.: 672,729

[22] Filed: Apr. 1, 1976

[51] Int. Cl.[2] ..... B31B 3/26

[52] U.S. Cl. ..... 93/49 R; 93/36.3

[58] Field of Search ..... 93/49 R, 36 MM, 36.3, 93/41, 36 R, 535 D

[56] References Cited

U.S. PATENT DOCUMENTS

| | | | |
|---|---|---|---|
| 1,905,334 | 4/1933 | Bicker | 93/36.3 X |
| 3,111,065 | 11/1963 | Jones et al. | 93/49 R |
| 3,512,459 | 5/1970 | Di Frank | 93/49 R X |
| 3,808,958 | 5/1974 | Keener et al. | 93/49 R |
| 3,815,482 | 6/1974 | Nelson | 93/36 R |

*Primary Examiner*—Roy Lake
*Assistant Examiner*—Howard N. Goldberg
*Attorney, Agent, or Firm*—Charles P. Bauer

[57] ABSTRACT

Apparatus for folding the panels of a bulk box blank into a tube. Such apparatus is particularly suited to fold the panels of extremely large heavy-weight blanks which are resistant to folding and therefore difficult to fold manually. The apparatus includes a vacuum hold down unit to hold and register the blank in position, folding arm assemblies to successively fold down the outer panels of the blank into a tube, and a hold-down device to restrain the folded panels from springing upward as the folded blank is moved into a compression unit.

9 Claims, 11 Drawing Figures

Fig. 2.
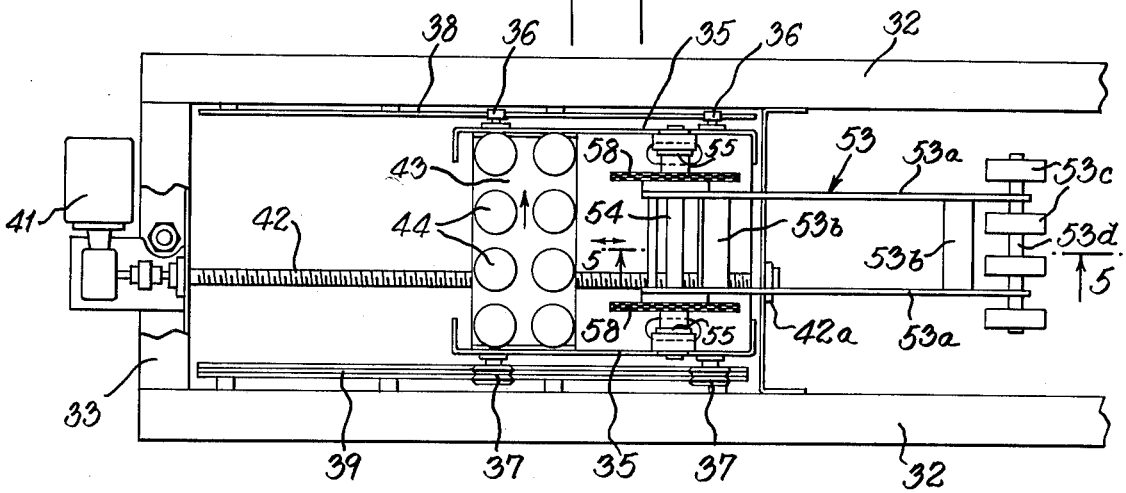
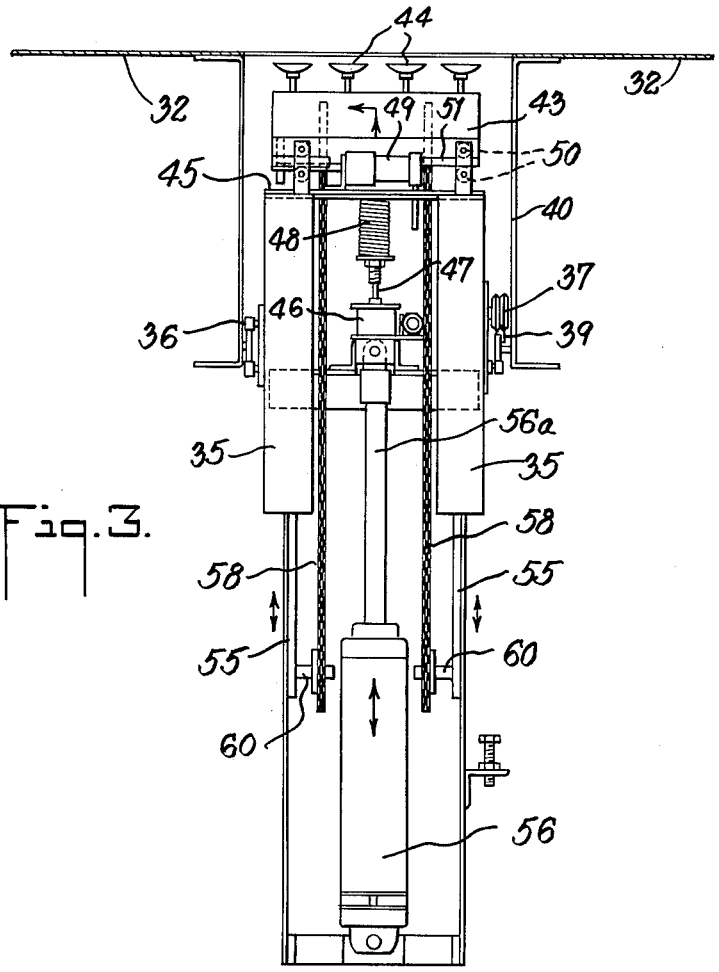
Fig. 3.

APPARATUS FOR FOLDING PANELS OF CARTON BLANK

BACKGROUND OF THE INVENTION

In U.S. Pat. No. 3,964,953 issued June 22, 1976, there is disclosed and claimed "Apparatus And Method For Laminating Liner to Box Blank," which is particularly suited for forming a blank for a bulk box which requires extra strength and rigidity in the side walls. Because of the extremely large size of the blank and its resistance to folding, it is difficult for one man to handle and fold it into a tube for shipment to a customer.

The apparatus of the present invention, although suitable for folding other large blanks, is particularly adapted for folding such laminated box blanks mentioned above.

The apparatus of the present invention thus eliminates folding by hand, reduces labor and production costs, and increases the production capacity.

SUMMARY OF THE INVENTION

It is an object of the invention to provide apparatus for folding the outer panels of a box blank, particularly where large blanks for bulk boxes with laminated side panels are to be folded.

It is a further object to provide apparatus for such folding which embodies means to hold and register the blank in position on the apparatus, folding arm assemblies to successively fold down such outer panels of the blank into a tube, and a hold-down device to restrain the folded panels from springing upward as the folded blank is moved into a compression unit.

It is a further object to provide apparatus for such folding which is efficient for its intended purpose and saves labor and costs and increases production capacity over presently known operations.

BRIEF DESCRIPTION OF THE DRAWINGS

Other objects and advantages will become apparent from the following description which is to be taken in conjunction with the accompanying drawings, in which:

FIG. 2 is a top plan view of the vacuum hold-down unit and folding arm assembly of the apparatus of FIG. 1;

FIG. 3 is an elevation view in cross-section of the apparatus of the vacuum hold-down unit and folding arm assembly of FIG. 2.

DESCRIPTION OF THE PREFERRED EMBODIMENT

Bulk Box Blank Construction

Figure 1:
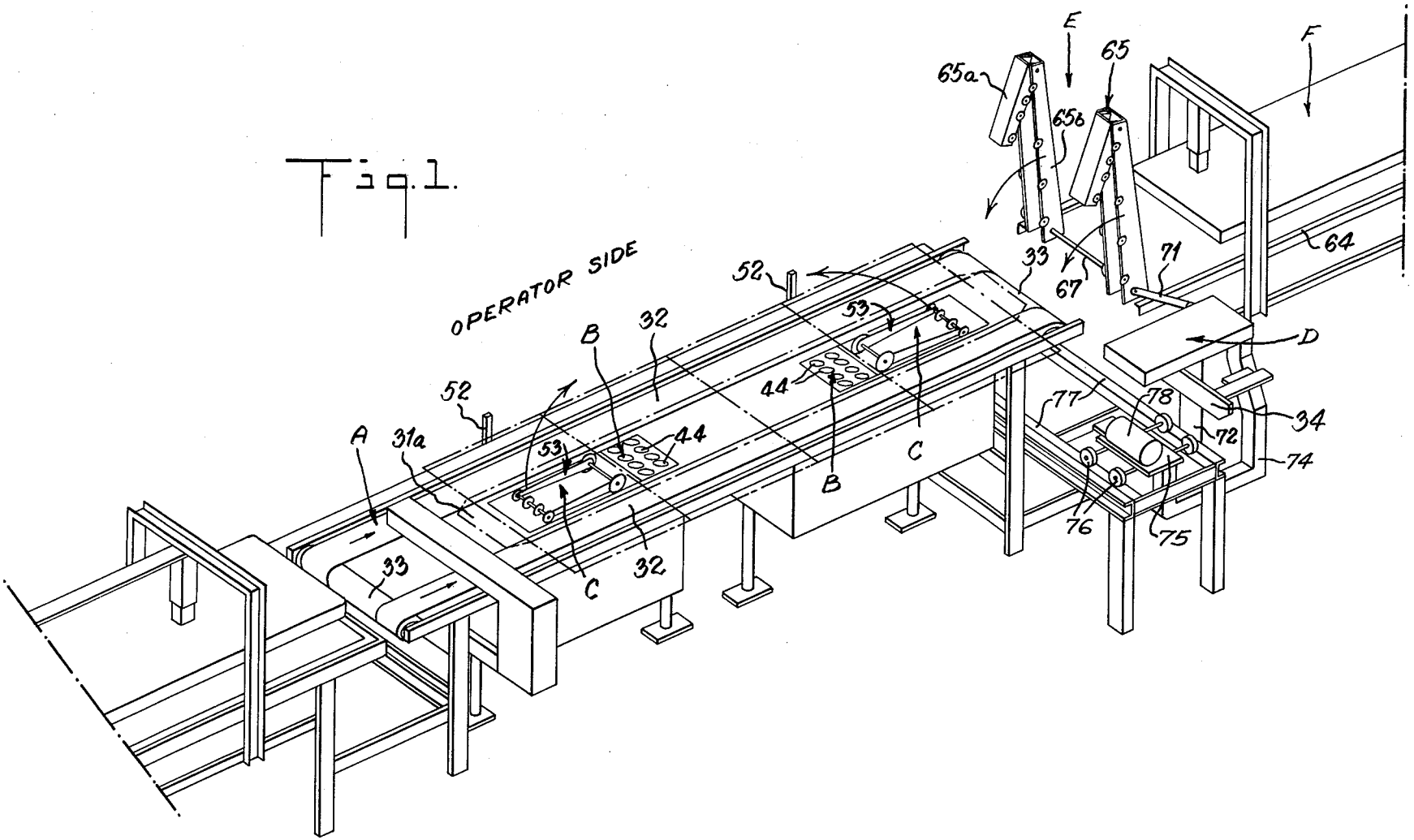
FIG. 1 shows a perspective view of the apparatus of the present invention.

Referring to the drawings, FIGS. 8 - 11 illustrate the type of blank to be folded and the manner of folding into a tube by the apparatus of the present invention. A bulk box made from such a blank can be formed with panels of multiple thicknesses of corrugated paperboard. Such construction results in a box empty weighing as much as 40 lbs. and which is used for shipping material weighing between 1000 and 2000 lbs.

The blank 20 is slotted and scored along longitudinal lines 21 and 22 and vertical lines 23, 24, 25 and 26 to define wall panels 27, 28, 29 and 30, attached bottom closure flaps **27*a*, 28*a*, 29*a* and 30*a*, attached top closure flaps 27*b*, 28*b*, 29*b* and 30*b*, andjoint flaps 31*a* and 31*b*. Such flaps 31*a* and 31*b* serve to secure the opposite ends of the blank together when the panels are folded to form the blank into a tube. It will be understood that one of the joint flaps 31*a* and 31*b* may be omitted, in which case the one joint flap will be secured to the opposite outer end, or both such flaps may be omitted, in which case the outer ends of the panels 27 and 30** will butt when the blank is folded into a tube and can be secured by tape or other means.

Although the apparatus is particularly suited for folding a blank of the type described above, it will be understood that such apparatus can likewise be used for folding other types of blanks where resistance to folding is a factor.

General Description of Apparatus

FIG. 1 shows the general layout of the apparatus which consists of the following major components designated in FIG. 1 with the capital letters A, B, C, D, E and F.

A. Blank conveyor table.
B. Vacuum hold-down units.
C. Folding arm assemblies.
D. Joint glue applicator.
E. Hold-down device.
F. Compression section.

The folding apparatus of the present invention may be operated as an independent unit or may be inserted between the compression section of the laminating apparatus (subject of application Ser. No. 561,984,) now U.S. Pat. No. 3964953 and the joint glue applicator. If operated as an addition to the laminating apparatus and joint glue applicator the control systems for such units are interlocked to permit either automatic or manual operation. The folding equipment may be operated in the automatic mode independently of the mode of operation of the laminating section.

In normal automatic operation, blanks enter the folding section from the laminating compression station. The split conveyor belts on the folding table deliver the blank to a stop located on the manufacturer's joint glue station, tripping a limit switch on the table to begin the cycle. Vacuum cup hold-down devices located on each of the two identical folding arm carriages raise to attach to the blank and, to assure alignment, register it against stops located on the operator's side of the machine. During this time the glue station is moving to the operator's side of the table to start applying glue. After the registration is completed and while the vacuum cups maintain a hold on the blank the glue application begins and the upstream arm begins folding. The arm extends from beneath the table to fold the end panel approximately 180°. When this fold is completed and the glue has been applied to the manufacturer's joint the downstream arm folds the glued end panel until it overlaps the previously folded panel. To prevent the folded blank from springing back the overhead hold-down device is lowered to restrain the panels and guide the folded blank under the compression platen. Once the hold-down arms are lowered, the vacuum cups release the box and the conveyor belt carries the box into the compression table. When the box moves under the platen, the overhead arms return to the rest position and the glue mechanism travels to the center of th table to receive the next blank.

I. Blank Conveyor Table

The blank conveyor table A, which is supported by legs, has a pair of spaced endless conveyor belts 32 running over rollers 33 at each end of the table. Such conveyor belts carry a blank, received from the laminating compression section or other blank feeder, along the length of the table until the end of the blank hits the stop 34 on the joint glue applicator D. At this stage the joint glue applicator and the stop 34 are positioned in the center of the table between the conveyor belts 32. A limit switch (not shown) on the stop 34 is tripped by the end of the blank which stops the belts and blank and begins the cycle. Initially the glue applicator moves to the operator's side of the apparatus and applies glue to the joint flap 31*b* and the adjacent edge of the panel 30. The joint glue applicator is only shown in the position on FIG. 1 to more clearly illustrate the construction of such applicator, the stop and the carriage for moving it across the machine.

As used herein the "operator's side" is the back side as viewed in FIG. 1 "Upstream" refers to the end of the apparatus where the blank is first fed into the apparatus. "Downstream" refers to the end of the apparatus where the blank leaves the apparatus to go into the compression Section F.

II. Folding Units

The two folding units are attached to the underside of the table A and have additional legs reaching to the floor. Each unit is made up of a carriage 35 which is mounted on wheels 36 and 37 that ride on tracks 38 and 39 inside a sheet metal housing 40 and is adjustable to fold blanks within the dimensional limits of the machine (FIGS. 2 and 3). The wheels 37 on one side have a center groove which mates with the pointed track 39 to prevent sidewise movement of the carriage. The carriage 35 carries the folding arm assembly B, the vacuum hold-down unit B, and the side register. The carriage is adjustable in the machine direction by means of a gear motor 41 with a drive connected to a threaded shaft 42. A captive nut 42*a* on the carriage causes the threaded shaft to move the carriage along the track. A selector switch at the operator's side of the machine is used to control the movement of the carriage. It is essential that the score line 24 of the blank be positioned between the vacuum hold-down unit and folding arm assembly of the upstream folding unit. Similarly the score line 26 of the blank will be positioned between the vacuum hold-down unit and the folding arm assembly of the downstream folding unit.

A. Vacuum Hold-Down

The vacuum hold-down units (FIGS. 2 and 3) include a tank 43 with a capacity for a plurality of vacuum cups 44, in this case eight. The vacuum tank and cups and associated assembly are mounted on a frame table 45 which can be raised or lowered for each new blank by means of a pneumatic cylinder 46, the shaft 47 of which is connected to a spring loaded rod 48 secured to the underside of the frame table 45. The vacuum cups attach to the underside of the blank near the folding score line to hold the blank on the table during the folding operation. When the folded blank is to be moved to the compression section, the vacuum cups are released and the raised cylinder 46 is returned to a rest position. The vacuum hold-down is also used to register the blank in the cross-machine direction.

B. Side Register

The side register (FIGS. 2 and 3) includes a pneumatic cylinder 49 that moves the vacuum cup tank and vacuum cups in a cross-machine direction on rollers 50 and tracks 51 toward the operator's side of the machine. The cylinder 49 is actuated after the vacuum cups have been raised and the cups have attached to the blank, and moves the blank against stops 52, thereby aligning the blank with the table.

C. Folding Arm

The folding arm 53 (FIGS. 2, 3, 4, 5 and 6) is mounted on a shaft 54 set in bearings on each side of a movable frame 55, which is guided on the carriage 35 and is powered by a pneumatic cylinder 56. The folding arm 53 is made up of side members 53*a* held in alignment by cross members 53*b.* At the one end of the arm are a set of free wheeling rollers 53*c* mounted on a shaft 53*d.* Mounted on the shaft 54 are a pair of spaced sprocket wheels 57 over which pass chains 58. Each chain passes over sprocket wheels 59 which are mounted on separate shafts 60 set in bearings on the sides of the moving frame 55. Each end of each chain 58 is secured by a threaded screw 61 and nuts 62 to a fixed frame member 63. The cylinder 56 is likewise affixed to the base of the movable frame 55. The movable frame 55 is set between rollers 55*a* and 55*b* on each side of the frame to guide the frame in its vertical motion. The mounting for the shaft 54 permits it to rotate freely within the mounting as the shaft is rotated by the sprocket wheels.

The folding arm 53 is at rest below the top surface of the table when the cylinder 56 is in the extended position. As the cylinder rod 56*a* is retracted, the frame 55 is pulled upward which in turn raises the folding arm 53 out of the table to maintain a near constant radius of contact with the panel during folding. As the frame 55 and the attached lower sprocket sheets 59 move upward it causes the chains 58, which are anchored at each end, to rotate the upper sprocket wheels, thereby transforming linear motion to rotational motion to rotate the arm approximately 180° from the rest position. Such 180° arm travel is adjustable by using a sprocket wheel with a larger pitch diameter for less travel and a sprocket wheel with a smaller pitch diameter for greater travel.

Figure 4:
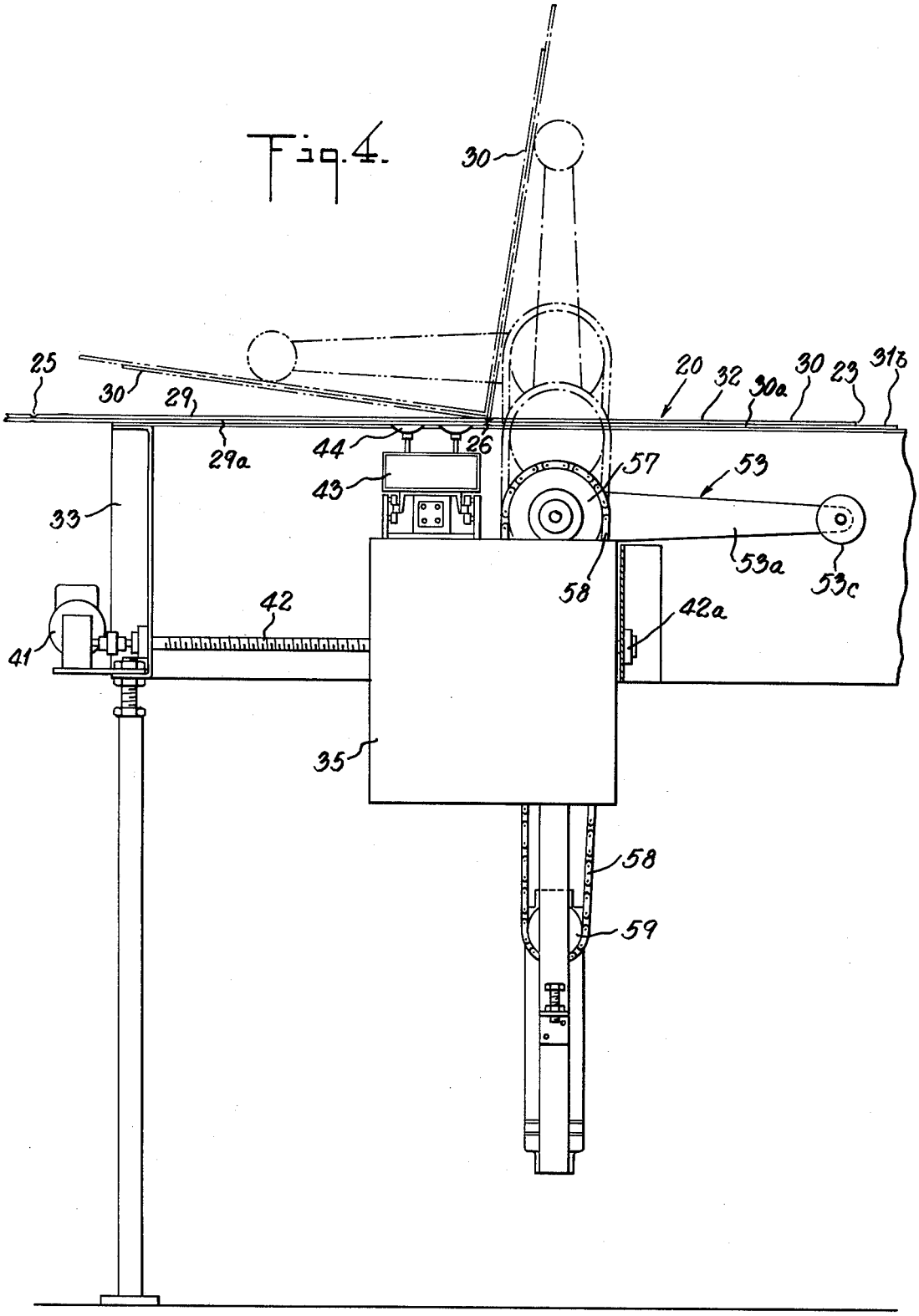
FIG. 4 is a side elevation view of the vacuum hold-down unit and folding arm assembly with the folding arm in various postions.
Figures 5, 6:
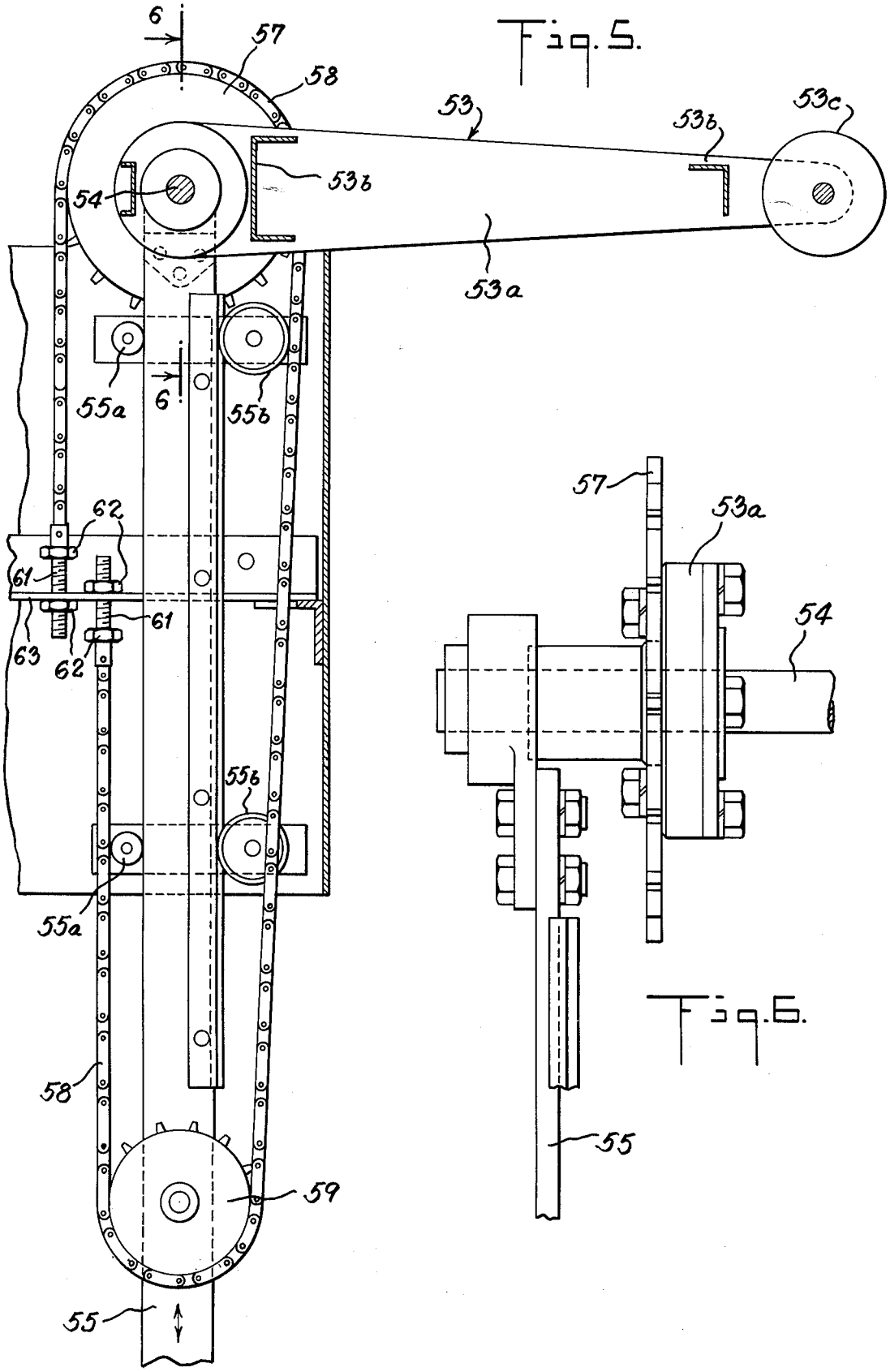
FIG. 5 is a view partly in section along the line 5—5 of FIG. 2.
FIG. 6 is a view along the line 6—6 of FIG. 5.

The upstream and downstream folding units are the same in construction and operation, the only difference being that one folding arm rotates in one direction whereas the other folding arm rotates in the opposite direction. FIG. 4 illustrates the downstream folding unit and shows the positions of the folding arm as it moves upward and rotates to fold the panel 30 backward along the score line 26 of the blank.

III. Hold-Down Device

Figure 7:
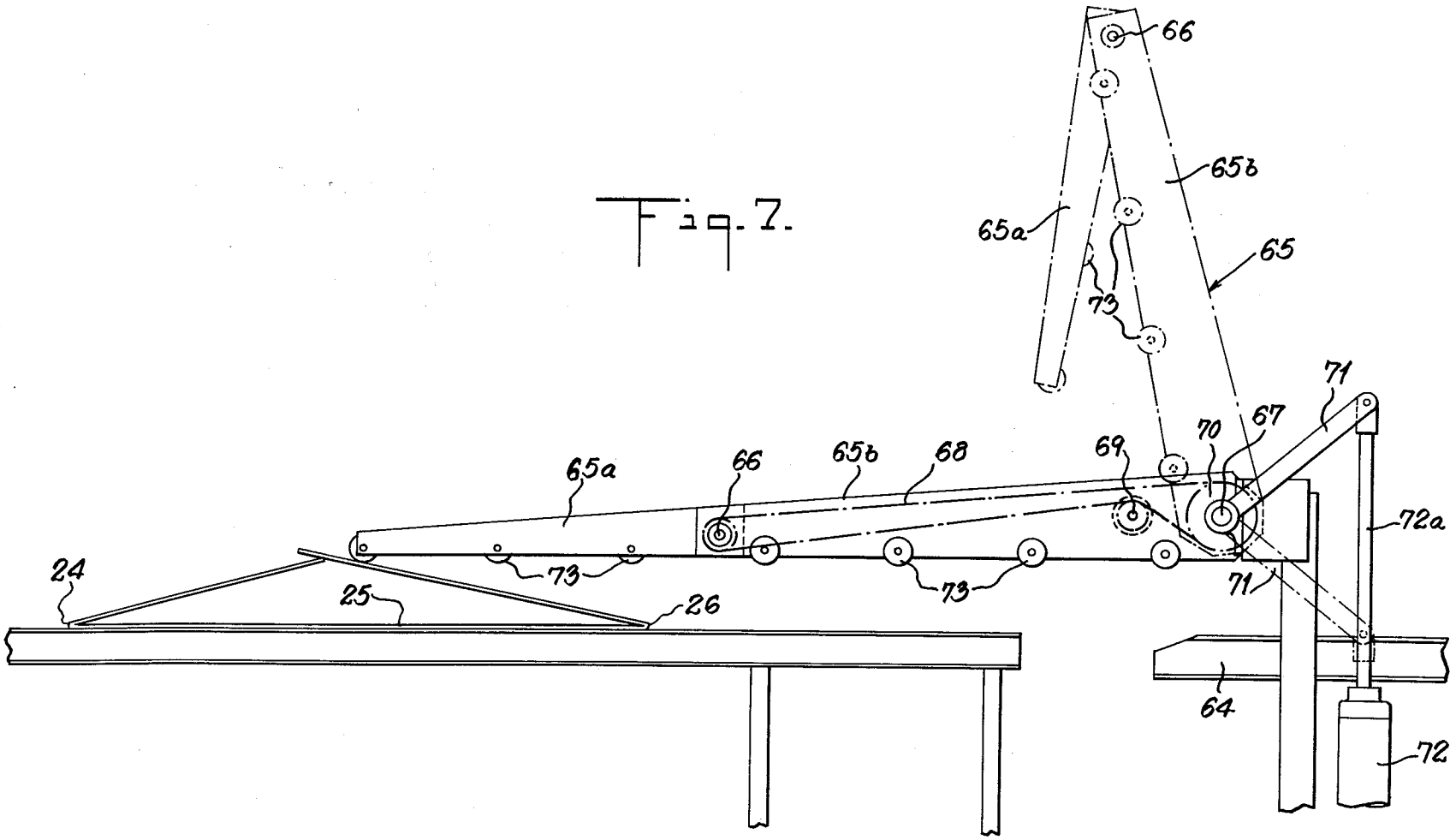
FIG. 7 is a side elevation of the overhead hold-down device.
Figure 8:
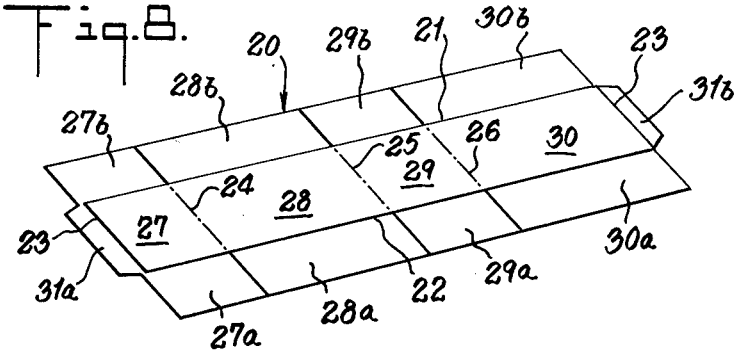
FIG. 8 is a perspective view of the blank to be folded by the apparatus of the present invention.
Figure 9:
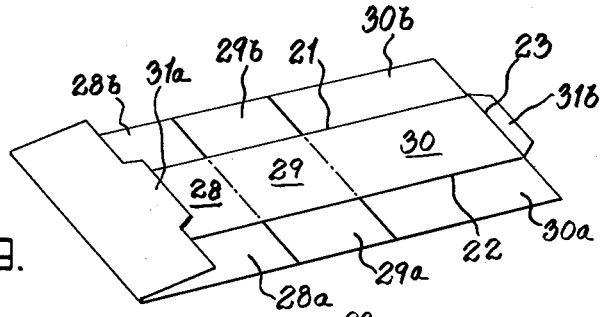
FIG. 9 is a view similar to that of FIG. 8 after the upstream arm has folded down the panel at one end.
Figure 10:
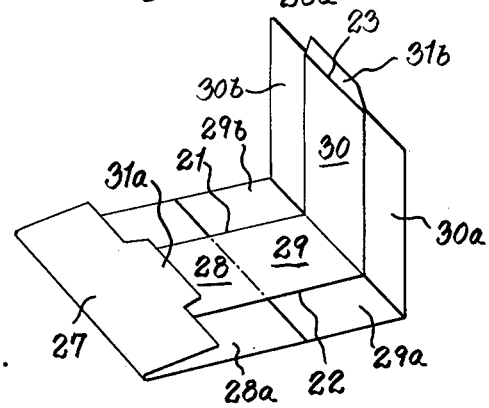
FIG. 10 is a view similar to that of FIG. 8 after the downstream arm has partially folded down the panel at the opposite end.
Figure 11:
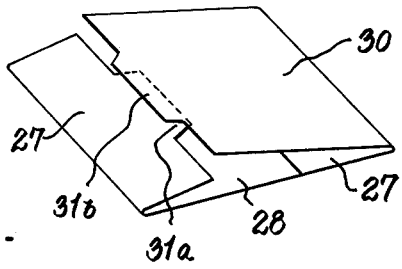
FIG. 11 is a view similar to that of FIG. 8 after the panels at each end have been folded down.

The overhead hold-down device (FIGS. 1 and 7) is located upstream of the platen 64 of the compression section F. Such device includes a pair of spaced arms 65 which are mounted in bearings affixed to the frame which is fastened to the floor and to the compression table for stability. Each arm is made of two members 65*a* and 65*b* connected with a pivot 66. Each arm is affixed to a rotatable shaft 67. An endless chain 68 passes over the pivot 66, a wheel 70 on the shaft 67, and an adjusting wheel 69 so that, by rotation of the shaft 67, the members of the arm can be folded in a vertical jack-knife style when at rest or extended into a virtual straight line. An arm 71 is affixed to the shaft 67, which arm is rotatably connected to the rod 72*a* of the pneumatic cylinder 72, so that actuation of the cylinder will cause the shaft to rotate and move the arms from a jack-knife position to a straight position. The arms have rollers 73 attached to the surfaces which contact the blank to allow the folded blank to move freely.

The arms 65 when at rest are illustrated in FIG. 1. When the downstream panel of the blank has been folded, the arms 65 are lowered, extending over the folding table parallel to the table top, to guide the folded blank under the platen of the compression section.

IV. Glue Applicator

The glue applicator D and the stop 34 are affixed to a frame 74 mounted on a carriage 75. There are wheels 76 on the carriage which ride on tracks 77 on a frame running in a cross-machine direction. Such carriage 75 is moved by means of a motor 78. At the start of the cycle the glue mechanism is in the center of the table so that the stop 34 will be in a position to stop the blank as it moves downstream on the table. As the vacuum hold-down devices grip the undersurface of the blank the carriage 75 and the glue applicator move across the table to the operator's side. The applicator then reverses direction and applies glue to flap 31*b* and adjacent strip of the panel 30 of the blank. When the glue has been applied, the carriage, glue applicator and stop will have moved to the drive side of the table out of the way of blank when it moves from the folding section to the compression section.

V. Compression Section

The compression section is a conventional piece of equipment which serves to hold the folded blank under compression as the glue on the manufacturer's joint sets. Such compression section need not be further described.

VI. Operation of Machine

A laminated blank is delivered to he folding table from the compression section and is conveyed until it hits the stop on the glue mechanism. The blank actuates a limit switch on the table which turns off the conveyor belts and starts the glue applicator moving to the operator's side of the machine to begin applying glue to the manufacturer's joint. Simultaneously, vacuum cups on the folding units are raised, attaching to the blank and registering the blank against the cross-machine direction stops. When the side registration is completed, the upstreamarm starts to fold the end panel. As soon as the glue mechanism has completed its travel and is clear of the blank and the upstream panel has been folded, the downstream arm starts to fold the glued panel.

When the downstream folding arm has rotated approximately 90° the overhead arms start to lower. When the overhead arms are in a position to hold the folded blank from sringing back, the upstream arm starts to retract after which the downstream folding arm starts to retract. When the downstream folding arm returns below the table the vacuum cups release the blank and the conveyor belts move the blank under the platen on the compression table.

As the folded blank moves into the compression table the overhead arms are returned to the rest position and the glue station moves to the center of the table to receive the next blank.

Thus among others, the several aforenoted objects and advantages are most effectively attained. Although a somewhat preferred embodiment of the invention has been disclosed and described in detail herein, it should be understood that the invention is in no sense limited thereby and its scope is to be determined by that of the appended claims.

Having thus described the invention, what is claimed is:

1. Apparatus for folding a bulk box blank scored to define side panels in which the opposite ends of the blank will be brought together to form a flat tube comprising:

a folding table;

means to feed the box blank onto the said table into a predetermined position;

means to retain the said blank in such predetermined position;

means to successively fold the panels at each end of the blank toward each other to bring the outer ends of such panels together for joining to form a tube comprising an upstream arm rotatable approximately 180° to fold the one said panel at one end and a downstream arm rotatable more than 90° to fold the other said panel at the opposite end;

a hold-down device adapted to apply pressure to the top of the folded blank and restrain the folded blank in flat condition; and means to feed the folded blank from beneath the hold-down device.

2. The apparatus of claim 1 wherein the blank includes a manufacturer's joint at one end and the apparatus includes means to adhesively secure the manufacturer's joint at one end to the end of the outer panel at the opposite end comprising a glue applicator having means to apply glue to the manufacturer's joint of the blank and then to move out of the path of the blank so that the blank will be free to be folded and fed from beneath the hold-down device and a compression section to receive the folded blank from the hold-down device and hold it under compression as the glue on the manufacturer's joint sets.

3. The apparatus of claim 1 wherein the means to retain the said blank in the predetermined position comprises a plurality of vacuum cups which raise from the folding table and attach to the undersides of the central panels of the blank adjacent the score lines between such panels and the outer panels of the blank.

4. The apparatus of claim 2 wherein the said means to retain the said blank in the predetermined position includes means to move the said vacuum cups and the attached blank in a cross-machine direction against stops to register the blank on the table in a predetermined cross-machine position.

5. The apparatus of claim 1 wherein the means to feed the box blank into a predetermined position on the said table comprises a movable stop having means to move the said stop into the path of the blank being fed onto the table to stop the forward motion of the blank at a set position and to move said stop out of the path of the blank when the blank is to be fed from beneath the hold-down device.

6. The apparatus of claim 1 wherein the folding arms are each mounted on a shaft to rotate the arm, each said arm and shaft when at rest being beneath the top surface of the table, each said arm and shaft having means to raise the said arm and shaft upward above the top surface of the table, to rotate the said shaft and arm, which rotation of the arms will turn the panels at each end of the blank toward each other to bring the ends of the blank into butting relationship, and thereafter to retract the said shaft and arms below the top surface of the table.

7. The apparatus of claim 6 wherein the means to raise and lower and to rotate each shaft and folding arm comprises:

a movable frame adapted to raise and lower;

the shaft on which the folding arm is mounted being rotatably mounted at the upper end of the movable frame;

a first upper sprocket wheel mounted on the said shaft and adapted to rotate said shaft;

a second lower sprocket wheel rotatably mounted at the lower end of the said movable frame;

a chain passing over the said sprocket wheels, the said chain being anchored at each end to a fixed frame member positioned between the said sprocket wheels; and means to raise and lower the said movable frame and the attached arm and shaft;

whereby linear motion of the movable frame will be transformed into rotational motion to rotate the said shaft and arm.

8. The apparatus of claim 7 wherein the means to raise and lower the said movable frame is a hydraulic cylinder having one end affixed to the base of the said movable frame and the other end affixed to a fixed frame member above the base of the said movable frame whereby retraction of the rod of the said cylinder will raise the said movable frame.

9. The apparatus of claim 1 wherein the hold-down device comprises an arm having two members connected by a pivot, one end of the arm being affixed to a rotatable shaft, and means to rotate the said shaft and the interconnected members from a jack-knife position when at rest to an extended virtual straight line position, the same hold-down device being positioned to bring the arm when extended against the top of the folded blank and when at rest out of the path of the blank when the blank is to be fed from beneath the hold-down device.

* * * * *